US005595290A

United States Patent [19]

Hsieh

[11] Patent Number: 5,595,290

[45] Date of Patent: Jan. 21, 1997

[54] SWITCH STRUCTURE WITH MULTIPLE USAGES

[76] Inventor: Hsuan-Jui Hsieh, 2F., No. 196-8, Sec. 3, Dah-Torng Rd., Shih-Jyy Jenn, Taipei Hsien, Taiwan

[21] Appl. No.: 563,722

[22] Filed: Nov. 28, 1995

[51] Int. Cl.[6] ..... H01H 19/20

[52] U.S. Cl. ..... 200/571; 200/570; 200/565; 200/568

[58] Field of Search ..... 200/571, 570, 200/569, 568, 564, 336, 284, 11 R, 14, 116, 565

[56] References Cited

U.S. PATENT DOCUMENTS

| | | | |
|---|---|---|---|
| 2,723,327 | 11/1955 | Gilbert | 200/570 |
| 2,813,158 | 11/1957 | Hutt | 200/571 |
| 3,359,393 | 12/1967 | Anthony et al. | 200/571 |

*Primary Examiner*—David J. Walczak
*Attorney, Agent, or Firm*—Pro-Techtor International

[57] ABSTRACT

A switch structure with multiple usages, in which the engaging seat is firmly associated with the main body only by means of engaging the the engaging hooks of the engaging seat with the reverse hooks of the main body without using any screw or rivet. The central shaft of the rotary switch is integrally formed with three arch stopper blocks and between each two arch stopper blocks is formed an acute driving block which such contacts with bent arms of the conductive plates and the connecting plate that when the rotary switch is rotated to rotarily drive the central shaft, the contacts of the central shaft are revolved clockwisely or counterclockwisely to change the positions of the contacts relative to the conductive plates so as to save power. A third conductive wire can be inserted through the other oblique notch of the main body into an insertion hole of the connecting plate to change the switch structure into one with three sets of wires.

3 Claims, 3 Drawing Sheets

SWITCH STRUCTURE WITH MULTIPLE USAGES

BACKGROUND OF THE INVENTION

The present invention relates to a switch structure with multiple usages, and more particularly to a switch structure in which the engaging seat is easily firmly engaged with the main body without using any screw or rivet. The rotary switch can be freely switched left or right so as to save power. The central shaft of the rotary switch is integrally formed without parts and can be easily manufactured and assembled so that the manufacturing labor, time and cost are reduced. A third conductive wire can be easily inserted into the switch structure so as to change the switch structure with two sets of wires into one with three sets of wires for multiple usages.

A conventional three-stage switch structure is circularly switched from an off position through a maximum position to a minimum position in order to adjust the input voltage. After such switch structure is switched on, a maximum current is permitted to flow through the switch, and then a minimum current is permitted to flow therethrough. Therefore, when it is desired to adjust the input voltage to the minimum value, two stages of operation is necessary prior to completion of the adjustment. This is inconvenient to the user and leads to waste of power. In addition, the voltage dropping diode of the switch is externally connected to the conductive wires of the conductive plates in a complicated manner. For solving the above problems, Taiwanese Utility Model Application No. 83208198 provides an improved switch structure which eliminates some drawbacks of the conventional switch structure. However, some shortcomings still exist in the improved switch structure as follows:

1. The base and upper cover of such switch are associated with each other by a screw in a relatively troublesome and time-costing manner.
2. Such switch can be only circularly clockwisely switched from an off position through a maximum position to a minimum position and then back to the off position. The counterclockwise rotation of the switch is idle without the function of voltage adjustment. For example, in case the current position of the switch is "maximum" and it is desired to shut off the power, the user must first rotate the switch to the position "minimum" and then to the position "off". There is no way to directly adjust the voltage from "maximum" to "off". Therefore, it is inconvenient to operate such switch and the power consumption is relatively great.
3. The rotary switch of such switch structure is assembled with the driving plates, spring, shaft post and conductive seat in a complicated and troublesome manner. Therefore, the manufacturing labor, time and cost are increased.
4. Such switch only serves as one with two sets of conductive wires with which an input and an output conductive plates are connected. A third wire cannot be added to such switch so that the application of such switch is limited.
5. The input and output conductive plates and the contacts of such switch are totally different from each other in structure so that the labor, time and cost for manufacturing the mold and the switch are ineconomically increased.

SUMMARY OF THE INVENTION

It is therefore a primary object of the present invention to provide a switch structure with multiple usages, in which the engaging seat is easily firmly engaged with the main body without using any screw or rivet. The rotary switch can be freely clockwisely or counterclockwisely rotated for switching so as to save power. The central shaft of the rotary switch is integrally formed without parts and can be easily manufactured so that the manufacturing labor, time and cost are reduced.

It is a further object of the present invention to provide the above switch structure in which a third conductive wire can be inserted through the other oblique notch of the main body into an insertion hole of the connecting plate to change the switch structure into one with three sets of wires.

The present invention can be best understood through the following description and accompanying drawing, wherein:

DETAILED DESCRIPTION OF THE PREFERRED EMBODIMENT

Figure 1:
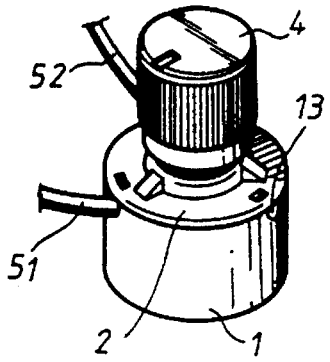
FIG. 1 is a perspective assembled view of the present invention.
Figure 2:
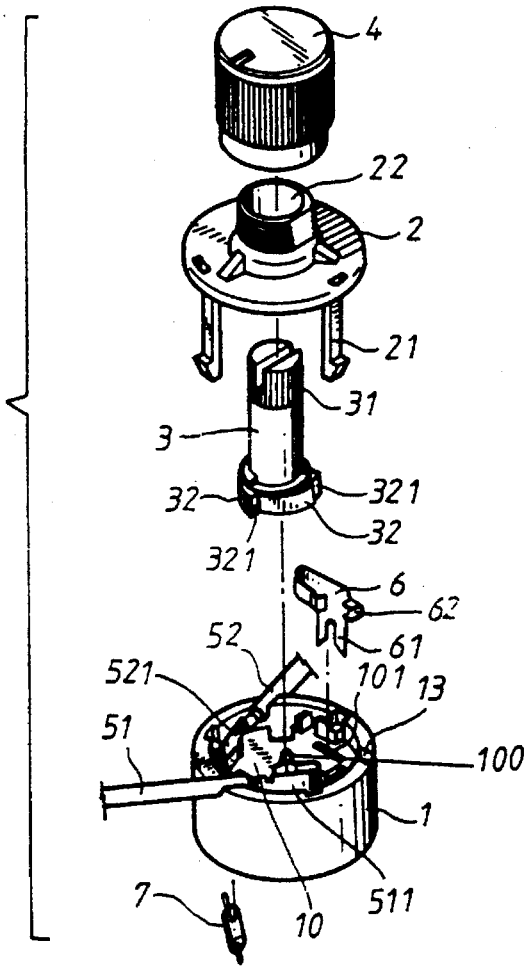
FIG. 2 is a perspective exploded view of the present invention.
Figure 3:
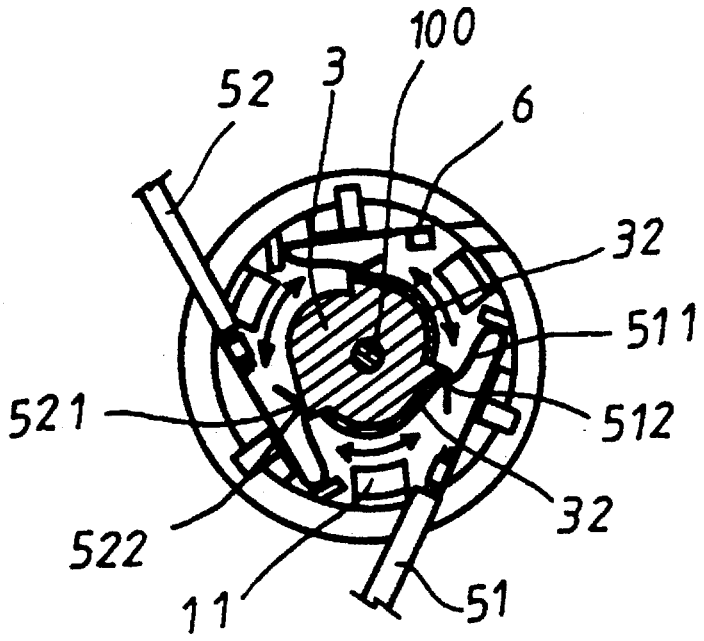
FIG. 3 is a sectional view of the present invention.
Figure 4:
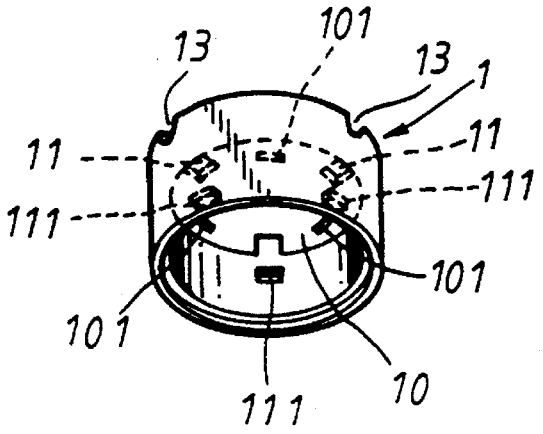
FIG. 4 is a perspective view of the main body of the present invention.

Please refer to FIGS. 1 to 5. The switch structure of the present invention includes a main body 1, an engaging seat 2, a central shaft 3, a rotary switch 4, two conductive wires 51, 52, a connecting plate 6 and a diode 7. The main body 1 is a circular body, having a recessed face portion 10 formed with three engaging holes 11 as shown in FIGS. 3 and 4. The engaging seat 2 has three engaging hooks 21 downward extending therefrom to pass through the engaging holes 11 and engage with three reverse hooks 111 of the main body 1. Therefore, the engaging seat 2 can be engaged with and secured to the main body 1 without using any screw or rivet.

The engaging seat 2 is formed with a central through hole 22. The central shaft 3 passes through the through hole 22 to engage with the rotary switch 4. The central shaft 3 has an insertion rod 31 at top end for inserting into an insertion socket of the rotary switch 4 (not shown), so that the rotary switch 4 is associated with the central shaft 3 and when the rotary switch 4 is rotated, the central shaft 3 is also rotated along with the rotary switch 4. The central shaft 3 has three arch stopper blocks at the bottom end thereof, wherein two of the three stopper blocks are disposed with conductive contacts 32 as shown in FIG. 3. When the central shaft 3 passes through the through hole 22 of the engaging seat 2, the stopper blocks with the contacts 32 are positioned at the bottom end of the engaging seat 2 within the face portion 10 of the main body 1. The face portion 10 has a central boss 100 for rotatably fitting into a shaft hole (not shown) formed on the bottom of the central shaft 3.

Figure 5:
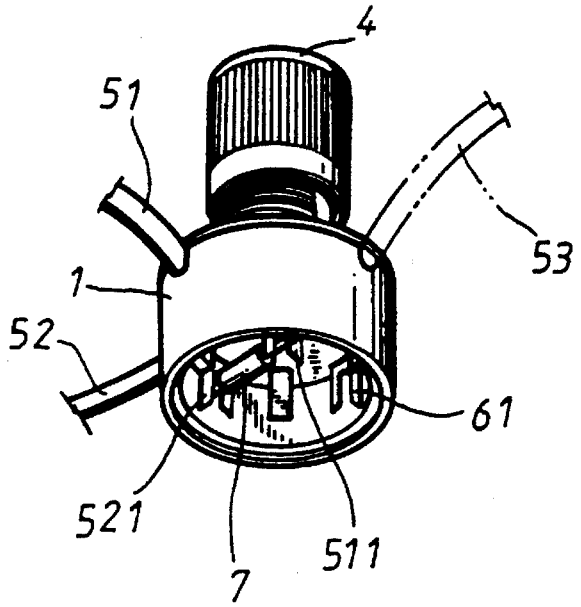
FIG. 5 shows that a third wire is inserted into the main body to change the switch structure into one with three sets of wires.

In addition, three oblique notches 13 are formed on the top edge of the main body 1 for inserting the two conductive wires 51, 52 therein. One of the wires 51, 52 is an input wire, while the other thereof is an output wire. Referring to FIG. 3, each wire 51, 52 has a conductive plate 511, 521 at front end, which is obliquely located in the face portion 10 of the main body 1. The conductive plate is identical to the connecting plate 6 in shape as shown in FIG. 2, having a forked bottom end identical to a fork portion 61 of the connecting plate 6. The forked bottom ends of the conductive plates 511, 521 and the fork portion 61 of the connecting plate 6 respectively pass through three slits 101 of the face portion 10 of the main body 1 and protrude out of the bottom of the face portion 10, so that the diode 7 is inserted between the conductive plates 511, 521 for electrically connecting the same as shown in FIG. 5.

Between each two arch stopper blocks of the central shaft 3 is formed an acute driving block 321 as shown in FIG. 3. The driving blocks 321 such contact with the bent arms 512, 522 of the conductive plates 511, 521 and the bent arm of the connecting plate 6 that when the rotary switch 4 is rotated to rotarily drive the central shaft 3, the positions of the contacts 32 at the bottom of the central shaft 3 relative to the conductive plates 511, 521 are changed, that is, when the central shaft 3 is clockwisely rotated, the driving blocks 321 of the central shaft 3 will press the bent arms 512, 522 of the conductive plates 511, 521 and a "kick" sound is emitted. The central shaft 3 can be also instantaneously counterclockwisely rotated. At this time, the driving blocks 321 will reversely press the bent arms 512, 522 of the conductive plates 511, 521 to emit a "kick" sound. Therefore, the rotary switch of the present invention can be clockwisely or counterclockwisely rotated for switching. (The conventional switch can be only clockwisely rotated for switching and the counterclockwise rotation of the switch is idle without switching operation.)

According to the above arrangements, the present invention has the following advantages:

1. The engaging seat 2 is firmly associated with the main body 1 only by means of engaging the the engaging hooks 21 with the reverse hooks 111 without using any screw or rivet.
2. The rotary switch can be freely switched left or right so as to save power. The acute driving blocks 321 of the contacts 32 such contact with the bent arms 512, 522 of the conductive plates 511, 521 and the bent arm of the connecting plate 6 that the rotary switch can be freely rotated clockwisely or counterclockwisely to switch on or off the power. (The conventional switch is circularly rotated three times for switching, that is, is circularly clockwisely rotated for switching and the counterclockwise rotation of the conventional switch is idle without switching operation. Therefore, the power consumption of the conventional switch is more than the present invention.)
3. The central shaft of the rotary switch is integrally formed without parts and can be easily manufactured and assembled so that the manufacturing labor, time and cost are reduced. (The conventional product is composed of assembled rotary switch, driving plates, spring, shaft post and conductive seat so that the manufacturing and assembling time and cost are considerably increased.)
4. The present invention can be changed into a switch with three sets of wires. In addition to the two wires 51, 52, a third conductive wire 53 can be inserted through the other oblique notch 13 of the main body 1 into an insertion hole 62 of the connecting plate 6 as shown in FIG. 5 so as to form a switch with three sets of wires. (The conventional switch is only applicable to two sets of wires and cannot be changed for three sets of wires.)
5. The conductive plates 511, 521 of the wires 51, 52 and the connecting plate 6 are identical in shape and structure so that they can be more easily economically manufactured at low cost.

It is to be understood that the above description and drawings are only used for illustrating one embodiment of the present invention, not intended to limit the scope thereof. Any variation and derivation from the above description and drawings should be included in the scope of the present invention.

What is claimed is:

1. A switch structure with multiple usages, comprising a main body, an engaging seat, a central shaft, a rotary switch, two conductive wires, a connecting plate and a diode, the main body having a recessed face portion formed with several engaging holes, the engaging seat having several corresponding engaging hooks extending downward therefrom to pass through the engaging holes and engage with several corresponding reverse hooks of the main body so that the engaging seat is engaged with and secured to the main body, the engaging seat being formed with a central through hole, the central shaft passing through the through hole to engage with the rotary switch, the central shaft having three arch stopper blocks at a bottom end thereof, wherein two of the three stopper blocks are disposed with conductive contacts positioned within the face portion of the main body, the face portion having a central boss for rotatably fitting into a shaft hole formed on a bottom of the central shaft, several oblique notches being formed on a top edge of the main body for inserting the two conductive wires therein, each wire having a conductive plate at a front end thereof, which is obliquely located in the face portion of the main body, each of the conductive plates and connecting plate having a bottom end passing through slits in the face portion of the main body and wherein the diode is inserted between the bottom ends of the conductive plates, between each two arch stopper blocks of the central shaft there is an arcuate driving block which contacts bent arms of the conductive plates and the connecting plate such that when the rotary switch is rotated to drive the central shaft, the contacts of the central shaft are switched into and out of electric contact with the conductive plates and the connecting plate and the contacts are revolved in either direction to change the positions of the contacts relative to the conductive plates and the driving blocks deflect the bent arms to thereby produce an audible sound.

2. A switch structure as claimed in claim 1, wherein the bottom ends of the conductive plates and the connecting plate are forked.

3. A switch structure as claimed in claim 1, wherein a third conductive wire is inserted through another oblique notch of the main body and into an insertion hole of the connecting plate.

* * * * *